US005855212A

United States Patent [19]

Walker

[11] Patent Number: 5,855,212

[45] Date of Patent: Jan. 5, 1999

[54] THUMB AND FINGER NAIL POLISH REMOVER DEVICE

[76] Inventor: Alvin Miller Walker, 143 Lake Shore Dr., Palm Harbor, Fla. 34684

[21] Appl. No.: 956,388

[22] Filed: Oct. 23, 1997

[51] Int. Cl.[6] ..... A45D 29/17

[52] U.S. Cl. ..... 132/73.5; 15/104.92; 15/167.3

[58] Field of Search ..... 132/74.5, 73, 73.5, 132/75, 75.3, 76.4; 401/122; 15/104.92, 167.3

[56] References Cited

U.S. PATENT DOCUMENTS

| | | | |
|---|---|---|---|
| 2,580,981 | 1/1952 | Webster | 15/104.92 |
| 3,316,922 | 5/1967 | Seidler | 132/75 |
| 4,022,228 | 5/1977 | Ropp et al. | 132/75 |
| 4,476,883 | 10/1984 | Diaz | 132/73 |
| 4,510,954 | 4/1985 | Miller | 132/75 |
| 4,819,672 | 4/1989 | Walker et al. | 132/73.5 |
| 5,048,547 | 9/1991 | Walker | 132/73.5 |
| 5,065,778 | 11/1991 | Terrell | 132/73 |
| 5,609,166 | 3/1997 | Walker | 132/73 |
| 5,613,506 | 3/1997 | Kurokawa | 132/73 |

*Primary Examiner*—Todd E. Manahan
*Assistant Examiner*—Eduardo C. Robert
*Attorney, Agent, or Firm*—Gipple & Hale

[57] ABSTRACT

A nail polish remover device adapted for removing finger-nail polish from all the fingers and thumb on a hand comprising a cylindrical receptacle defining a chamber with a liner casing mounted within the chamber. A finger support member defining a plurality of concave recesses to receive the fingers of a user is secured to the liner casing and a plurality of bristle members extend from a side support of the liner casing toward the concave recesses. A thumb support member defining two concave recesses is secured to the liner casing and a plurality of bristle members are mounted to the liner casing and project toward the thumb recesses.

20 Claims, 2 Drawing Sheets

THUMB AND FINGER NAIL POLISH REMOVER DEVICE

BACKGROUND OF THE INVENTION

1. Field of Invention

The present invention relates to devices for removing fingernail polish and in particular relates to a molded container having an insertible one piece molded bristle liner suitable for removing fingernail polish from the thumb and fingers of either hand.

2. Description of the Prior Art

The prior art contains many references directed to nail polish removal receptacles which support or suspend an insert structure to aid in the removal of hardened nail polish from fingernails after a finger has been immersed in nail polish remover contained within the receptacle. U.S. Pat. Nos. 4,474,195; 4,440,181; and 4,282,891 disclose nail polish remover devices in which a receptacle is provided with a sponge or sponge-like absorbent member insert. The sponge member insert is formed with an aperture forming a finger hole into which the finger is placed. The absorbent sponge absorbs nail polish remover and upon insertion of the finger into the sponge aperture, the polished fingernail comes into contact with the sponge and nail polish remover solution to remove the polish from the nail. The solution and polish fragments are wiped from the inserted fingernail by the sponge as the fingernail is removed from the receptacle jar. A multilayer foam surgical scrub sponge similar to those shown in the patents noted above is disclosed by U.S. Pat. No. 4,866,806. In this reference a removable serrated insert is accommodated in the center of the sponge to enable insertion of the fingers to cleanse and disinfect the cuticle areas.

U.S. Pat. No. 4,480,351 discloses a surgical scrub brush provided with two sets of brushes in each side of the molded container body. The brush bristles are formed with a configuration of smaller bristles disposed in a longitudinal channel or gap between taller bristle groups whose tips are laterally exposed to facilitate nail cleaning. The individual bristle members have a triangular cross-section.

Another surgical scrub brush is shown in U.S. Pat. No. 3,966,335. This patent features four bristle-lined troughs for simultaneous scrubbing of the four fingers. Rows of relatively short stiff bristles are used for cleaning the finger tips, nails, and under the nails.

U.S. Pat. No. 4,397,324 discloses a nail polish receptacle which is provided with a brush member disposed in the receptacle by wire legs which support the brush element in the approximate determines of a circular finger opening. Similarly, U.S. Pat. No. 4,321,936 discloses a nail polish remover receptacle containing a plurality of downwardly spaced apart free floating legs with an inwardly curved end portion. The legs have bristles or brush like elements secured thereto which extend inward. When a person inserts a finger into the device, the finger will contact the bristles and push the legs outward in such a manner that the nail polish remover liquid on the bristles will remove the nail polish from the fingernails. U.S. Pat. No. 3,316,922 discloses a nail polish remover device in which a circular brush with a circular open center is mounted on a group of abutments extending inwardly from an insert surface. The brush member is positioned on the abutments and the brush stem is moved against the abutments to snap into an inclined position. In U.S. Pat. No. 2,771,621 a reciprocating spring braced member carries a brush head with bristles extending into a recess into which a finger is placed to remove the nail polish.

U.S. Pat. No. 4,397,324 discloses a combination golf ball and club head cleaner that is mounted to the fender of a golf cart or post. The device includes a watertight housing having a first brush-lined chamber for cleaning a golf ball and a second brush-lined parallelepiped chamber for cleaning a golf club. A ball holder mounted for reciprocation along its vertical axis in the ball cleaning chamber retains a golf ball allowing it to rotate when scrubbed. Brushes lining the first chamber scrub the ball as the holder is reciprocated.

An apparatus for cleaning and sanitizing combs through mechanical bristles and disinfectant fluids is disclosed in U.S. Pat. No. 5,454,131. The apparatus includes a container having a rectangular base with enlarged rectangular front and rear walls and smaller rectangular side walls. The container further includes a lid having a lower open end which is removably positioned on the upper edges of the walls. A plurality of pointed semi-rigid bristles are secured to the interior surfaces of the front and rear walls of the container.

U.S. Pat. Nos. 5,048,547 and 4,819,672 issued to the present inventor disclose a cylindrical housing holding a one piece brush assembly which has inwardly projecting integral triangular shaped bristles configured to receive a finger and remove the fingernail polish.

One patent of interest which is directed toward cleaning the thumb and fingers of a hand is U.S. Pat. No. 4,476,883. This patent discloses an U-shaped container assembly for applying a predetermined liquid or solution to the fingernails of a person. A sponge material is disposed in the interior of a housing and is provided with a plurality of recesses dimensioned and configured to receive the fingertip and the fingernail of the user in a predetermined array facilitating placement of all the fingers and thumbs in the various recesses. A liquid or solution is applied to the interior of the housing and the sponge material and the housing is filled to a level sufficient to form small pools in the bottom of each of the finger recesses.

Another thumb and finger cleaner, U.S. Pat. No. 5,065,778 discloses a fingernail polish removing container with a base, and a lid, and a fingernail scrubbing structure mounted within the container in spaced relation to the container base bottom wall and to the lid top wall. In some of the disclosed embodiments the finger nail scrubbing structure is supported within the container base, and includes five finger bore openings, four of which are of substantially equal diameter on a circle with the fifth bore opening, a thumb tip receiving opening, being of greater diameter than the other four finger openings and displaced closer to the center of the fingernail scrubbing structure to receive simultaneously the fingernails of the fingers and thumb of one hand. The finger bore openings are provided with sponge like inner walls to remove nail polish from the nails, and the nail polish removing liquid is sloshed between the bottom and the upper chambers to saturate the finger bore opening wall surfaces.

Another finger nail cleaning patent which uses a mechanical pump assembly, U.S. Pat. No. 4,020,856, pulsates jets of liquid to the ends of the fingers of a user's hand while the hand is positioned on a grooved hand rest.

It can thus be seen that the aforenoted patents do not teach or disclose the present invention which utilizes a molded container having a removable one piece integrally molded bristle liner which provides a simple means of removing nail polish from the thumb nail and fingernails of each hand in a clean environment relatively free of bacteria and virus. Many of the above cited patents use sponge or sponge-like product to apply nail polish remover to the fingernails. There are health reservations about the use of sponge product in beauty salons because of the occurrence of bacterial collection and growth in the sponge.

SUMMARY OF THE INVENTION

The present invention provides for a unique injection molded nail cleaning apparatus receptacle which provides for an improved fingernail cleaning and conditioning, through the use of a removable molded brush bristle liner. The device is made of three separate injection molded pieces: the container itself, the liner which has the integrally molded bristles, thumb support and fingers support, and a cap. The separate, molded, removable cylindrical liner snaps into place in a groove formed in the inner wall of the cylindrical container and holds the composite bristle liner in place. Thus, the invention, comprises a standard cylindrical container with an insert having inwardly extending bristles and separate thumb and finger supports. The bristles are formed in two sections, one a curved configuration facing the thumb support section and the other formed in a straight configuration facing the finger support section.

It is an object of the invention that the bristle section positioned in a linear relationship in relation to the finger section provides maximum contact with the fingernails when the fingers are inserted into the interior of the polish remover container. The bristle section positioned in a curved relationship to the thumb section provides maximum contact with the thumb of either hand. Each bristle section has spaced bristle rows which are separated to allow a constant flow of nail polish remover or conditioner into the brushing area during the brushing period and continuous circulation of the liquid throughout the container.

It is another object of the invention that the container can be easily cleaned or sterilized to remove any bacterial or viral growths as well as any cuticle material that has been torn or pulled off by the bristles by removing the cylindrical liner and sterilizing it or replacing it with a new one. Proper sterilization and hygiene are of the utmost importance to the cosmetology industry and to the individual retail consumer. Cleanliness is of particular importance if the soft tissue surrounding the fingernail, especially the cuticle area, is open and bleeding. This frequently occurs due to job related tearing of the cuticles or from habitual fingernail biting. Such open wound areas are frequently sources for the transmission of dangerous pathogens such as bacterial, fungi, and viruses. It is possible that this could be a pathway for the transmission of acquired immune deficiency syndrome (AIDS) if several people use the same container. In any event, there is a common perception among consumers that a multiply used container presents such a problem.

Another important objective of the present inventive nail polish remover device is to provide the user with a means for removing nail polish from the thumb and multiple fingers of one hand simultaneously. To accomplish this, the opening of the nail polish remover container is separated into sections to accommodate a thumb and four fingers of the user's hand. The insert incorporates a centered novel tapered finger support and a tapered thumb support which rise in an upward direction into the interior of the chamber of the receptacle. These tapered supports serve several purposes; namely, reducing the volume of the interior of the container so that an excessive amount of nail polish remover will not be required to raise the fluid level of the device; and to provide placement of the fingers against the finger bristle section and the finger support while also providing placement of a thumb of either hand against the thumb bristle section and the thumb support.

These and other objects, advantages, and novel features of the present invention will become apparent when considered with the teachings contained in the detailed disclosure along with the accompanying drawings.

DETAILED DESCRIPTION OF PREFERRED EMBODIMENT

Figure 1:
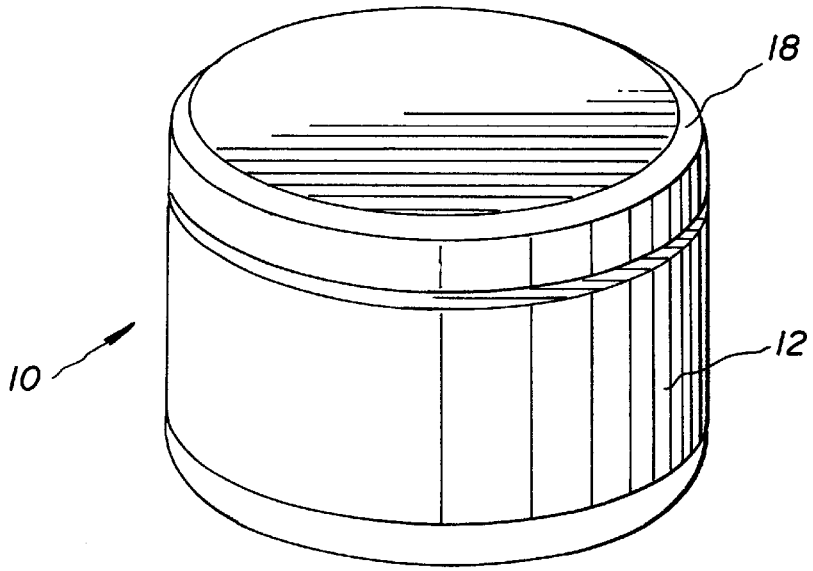
FIG. 1 is a perspective view of the nail polish remover device.
Figure 2:
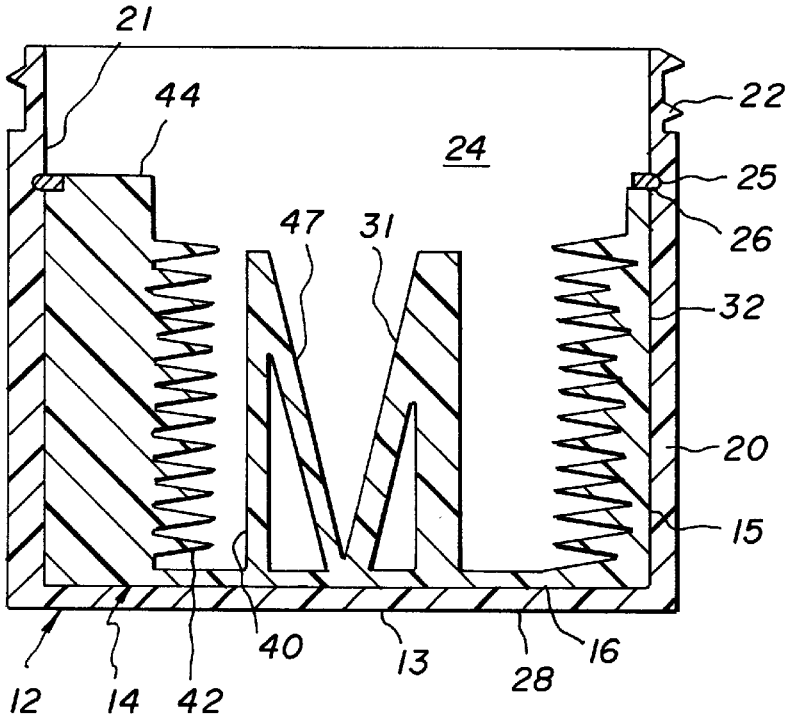
FIG. 2 is a cross sectional view of nail polish remover device with cap removed shown in FIG. 1 taken along line 2'—2' of FIG. 3 when the insert has been placed in the container.
Figure 3:
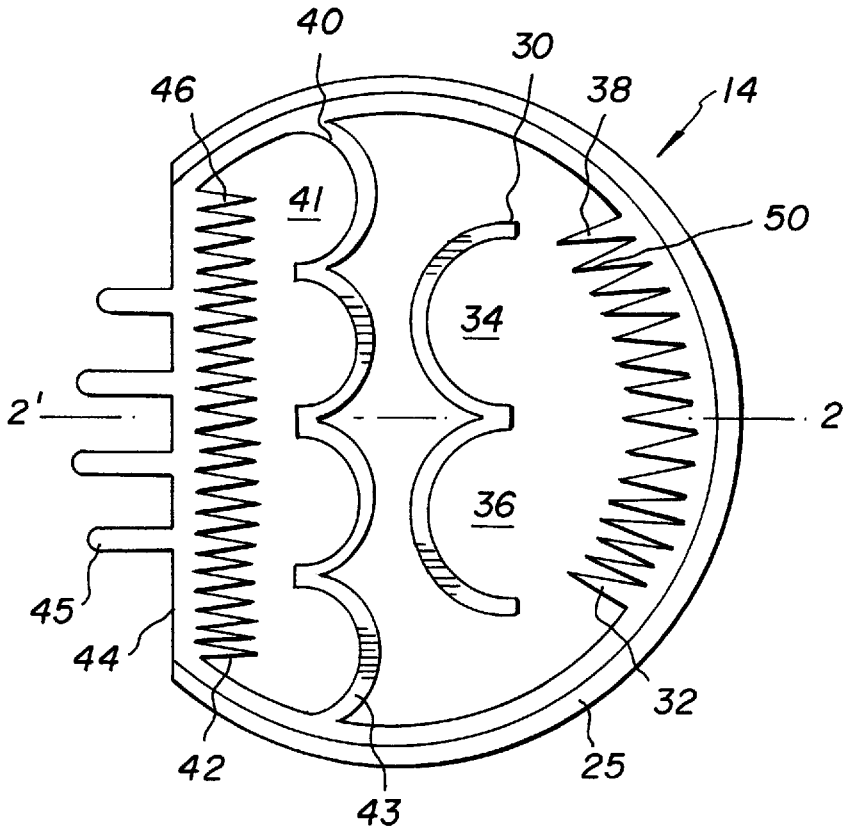
FIG. 3 is top plan view of the nail polish remover insert.

The-preferred embodiment and the best mode of the present invention is shown in FIGS. 1 through 3. As shown in the Figures, the inventive nail polish remover device is generally designated by the numeral 10 and comprises three basic pieces or parts: a cylindrical container 12, a bristle liner 14 having an integrally molded side wall 15, base 16, bristle sections 32 and 42 and a threaded cap 18. The container 12 has a cylindrical wall 20 which forms a circular opening at the top or proximal end of the container 12 thereby providing a means for the fingers and thumb to enter the container chamber 24. The exterior outer surface of the cylindrical wall 20 is formed with threads 22 which engage and hold cap 18. The interior wall surface 21 of the cylindrical wall 20 is provided with an annular bristle liner receptor groove 26.

The bristle liner 14, which is a separately molded piece preferably of a flexible plastic material such as polyethylene or polypropylene, is of an appropriate size and shape to line the interior wall surface 21 of the container 12. The bristle liner 14 has an external bead or rib 25 formed around the upper periphery which is dimensioned to form a snap fit in cylinder wall groove 26. The base 16 of the bristle liner is provided with an upwardly extending thumb section 30 and thumb bristle section 32 and an upwardly extending finger section 40 and a finger bristle section 42. The thumb section 30 defines a wave or undulating cursive "W" configuration with a left thumb arcuate recess 34 and a right thumb arcuate recess 36 with the bristles rows 38 of the thumb bristle section 32 extending inward toward the thumb recesses 34 and 36. The thumb section 30 has an inclined support 31 and the front faces of the thumb section facing the bristle rows 38 can be tapered if desired to allow easy entry of the thumb of the user. The finger section 40 defines a plurality of curved finger recesses 41. Each of the four finger recesses is formed by a semicircular portion 43. The finger bristle section 42 has a planar facing base member 44 and integrally formed external ribs 45 which abut against inner surface 21 of the container wall 20 to give support to the bristles 46 of the bristle section 42 as the fingers engage them during the cleaning procedure. Both the finger section 40 and thumb section 30 are supported and kept in place by supports 47 and 31 respectively. Support member 47 is angled in the same manner as support 31 and the front face of each finger portion 43 also tapers upward to allow easy insertion of the fingers. Rows of bristles 46 extend inwardly in chamber 24 toward the finger recesses 41. The bristle rows 38 and 46 are constructed of spaced rows of bristle pairs 50 extending generally toward the respective thumb recesses 34 and 36 and finger recesses 41. The bristles pairs are equally spaced along each row and are of equal length. The two bristles of each bristle pair are angularly positioned away from each other and form a V shaped spacing. Each bristle forms an angle which will intersect with the adjacent bristle of the adjacent bristle pair. The spaces between the pairs of bristles and between the rows of bristles allow the nail polish remover solvent placed within the chamber 24 of the container 12 to flow freely into the brush area. The brush surface thus is directly positioned across from the fingers and thumb recesses and has no metal parts or sponge-like foam.

The cylindrical bristle carrier liner 14 is made of a flexible and resilient plastic material that can be deformed when a balanced force is applied but returns immediately to its original shape after the force is removed so that the annual rib 25 on the cylindrical bristle liner can be snap fit or snugly fit into the annular container groove 26 to hold the cylindrical bristle liner firmly into place within the container chamber 24. When cylindrical bristle liner 14 is snapped into place within the container chamber 24, the distal end or base 28 of the cylindrical bristle liner engages the container bottom 13 and the side wall 15 is positioned adjacent inner cylindrical surface 21. In the preferred embodiment the container 12 is made of a relatively hard, inflexible plastic and the inner liner 14 and bristles are made of a relatively soft flexible plastic material.

Variations of the above preferred embodiment are contemplated by the inventor. The cap 18 in the illustrated best mode and preferred embodiment is secured to the container 12 by means of screw threads 22 as described above but other means of attaching the cap which are well-known in the art can be used.

In addition, other shapes for the nail polish remover receptacle are contemplated by the inventor including ellipsoidal or oval. Bristles of different lengths, diameters, degrees of stiffness, and of various shapes and numbers may be used. For example, the tips of the bristles can be conical or pointed, rounded, flat, or chisel shaped. Each bristle blade has a generally triangular base and three flat surfaces. The bristles of the illustrated preferred embodiment are integrally formed with the liner 14 by molding them as one piece. Individual natural or synthetic bristles or groups of bristles may, however, be secured to the liner 14 by any means known to one skilled in the art.

The device is designed so that it can be easily and economically fabricated by injection molding and the bristles can be integrally molded with the liner 14. The entire construction of the container 12, liner 14, and cap 18 is preferably made from a flexible and resilient material such as polyethylene or polypropylene. The flexible and resilient plastic material is chosen so that the removable liner can be readily snapped into place or removed to provide for easy assembly of the device and replacement of the liner 14. The composition of the nail polish remover device 10 is such that it is virtually impervious to the deleterious effects of nail polish solvent in both its liquid and vapor phases. In other embodiments the cylindrical bristle liner 14 can be made without the bead 25 and held in place by sonic welding the same directly to the container or by other techniques known to one skilled in the art. The solvent solution can be emptied from the container chamber 24 and container washed out as desired and reused in any manner desired to provide optimum cleanliness and hygiene.

In operation the container is filed with polish remover. The user inserts a plurality of fingers into the container chamber 24 and the finger recesses 41 where the fingernails come in contact with nail polish remover solvent and the tips of the bristles 46 extending into the container chamber. The fingernails are moved across the bristles 50 to score the painted surface, further aiding in the removal of the polish. Simultaneously, the respective thumb is placed in either thumb recess 34 or 36 depending upon which hand is being cleaned and engages bristles 38 in the same manner the finger nails engage their respective bristles. The fingers and thumb are supported and orientated respective by finger sections 40 and thumb section 30 as the fingertips are moved across the bristle tips. Upon the removal of the fingers from the nail polish remover device, the bristles revert to their original memory positions.

In the foregoing description, the invention has been described with reference to a particular preferred embodiment, although it is to be understood that specific details shown are merely illustrative, and the invention may be carried out in other ways without departing from the true spirit and scope of the following claims:

What is claimed is:

1. A nail polish remover device comprising:

a container defining a top opening and a container chamber;

a removable integrally formed liner mounted in said container comprising a substantially cylindrical housing with a base, a finger support member defining a plurality of finger recesses secured to said base and finger bristle means secured to said liner and positioned opposite said finger support member; and a thumb support member secured to said cylindrical housing base, said thumb support member defining at least one thumb recess and thumb bristle means secured to said liner and positioned opposite said thumb support member.

2. A nail polish remover device as claimed in claim 1 wherein said thumb support member defines two thumb recesses.

3. A nail polish remover device as claimed in claim 1 wherein said finger bristle means comprises a linear side base member with a planar interior surface, and a plurality of bristles extending from said planer surface.

4. A nail polish remover device as claimed in claim 3 wherein said linear side base member defines an exterior surface with a plurality of ribs extending therefrom.

5. A nail polish remover device as claimed in claim 1 wherein said liner includes a bead means which mates with a groove defined in said container.

6. A nail polish remover device comprising:

a container comprising a base and wall means surrounding said base to define a top opening and a container chamber;

a removable integrally formed liner member comprising a substantially cylindrical outer casing removably mounted to an interior surface of said container, said liner member including a thumb support member defining at least one concave recess to receive a thumb and a finger support member defining a plurality of concave recesses to receive a plurality of fingers;

bristle means formed on an interior surface of said liner member and extending therefrom into the container chamber opposite said thumb support member and said finger support member when said liner is mounted in said container chamber; and support holding means mounted on said liner member for supporting said thumb support member and said finger support member.

7. A nail polish remover device as claimed in claim 6 where said liner member, said finger support member and said thumb support member, and said bristles means are integrally molded of a flexible and resilient material.

8. A nail polish remover device as claimed in claim 7 wherein said material is polypropylene.

9. A nail polish remover device as claimed in claim 7 wherein said material is polyethylene.

10. A nail polish remover device as claimed in claim 6 wherein said bristle means comprises two bristle assemblies, one positioned opposite said thumb support member and the other positioned opposite said finger support member.

11. A nail polish remover as claimed in claim 6 wherein said thumb support member defines two concave recesses, one on each side of a line drawn across the diameter and axis of the liner cylindrical outer casing and intersecting said finger support member.

12. A nail polish remover as claimed in claim 11 where said thumb support member is comprised of two semicircular sections, each section being supported by an angled support member which engages a base of said liner member.

13. A nail polish remover device comprising:

a cylindrical container with a base and wall means extending from said base defining a top opening and a container chamber, a removable liner comprising a base, a substantially cylindrical wall mounted to and extending from said base, a plurality of bristle members integrally formed with said substantially cylindrical wall, said bristle members defining a concave recess, a thumb member mounted to said liner base, said thumb member defining a plurality of concave recesses to receive a thumb and being positioned opposite said bristle members defining a concave recess, a finger bristle assembly mounted to said substantially cylindrical wall, said finger bristle assembly comprising a linear base member and a plurality of bristle members mounted to said linear base member, said bristle members integrally formed with said cylindrical wall and said finger bristle assembly linear base member extending into the interior of said container chamber, a finger support member mounted to said cylindrical wall, said finger support member defining a plurality of concave recesses adapted to receive the fingers of a user, said finger support members recesses being positioned opposite said finger bristle assembly.

14. A nail polish remover device as claimed in claim 13 wherein said thumb member includes a thumb support member.

15. A nail polish remover device as claimed in claim 14 wherein said thumb member defines two arcuate recesses.

16. A nail polish remover device as claimed in claim 13 wherein said finger member includes a finger support member.

17. A nail polish remover device as claimed in claim 16 herein said finger member defines four arcuate recesses.

18. A nail polish remover device as claimed in claim 13 wherein said finger bristle assembly base member has a plurality of integrally formed outwardly extending rib members.

19. A nail polish remover device as claimed in claim 13 wherein said thumb member and said finger support member each have an angular support arm secured to said liner base.

20. A nail polish remover device as claimed in claim 13 wherein said thumb member and said finger support member are comprised of a plurality of substantially semicircular sections, each section defining a concave recess.

* * * * *